US007522136B2

(12) United States Patent
Park et al.

(10) Patent No.: US 7,522,136 B2
(45) Date of Patent: Apr. 21, 2009

(54) LIQUID CRYSTAL DISPLAY DEVICE AND DRIVING METHOD THEREOF

(75) Inventors: Su Hyun Park, Ahnyang-shi (KR); Jong Hoon Woo, Uiwang-shi (KR)

(73) Assignee: LG Display Co., Ltd., Seoul (KR)

( * ) Notice: Subject to any disclaimer, the term of this patent is extended or adjusted under 35 U.S.C. 154(b) by 822 days.

(21) Appl. No.: 10/960,934

(22) Filed: Oct. 12, 2004

(65) Prior Publication Data

US 2005/0116920 A1 Jun. 2, 2005

(30) Foreign Application Priority Data

Dec. 2, 2003 (KR) ..... 10-2003-86957

(51) Int. Cl.
*G09G 3/36* (2006.01)

(52) U.S. Cl. ..... 345/88; 345/690; 362/561

(58) Field of Classification Search ..... 345/87, 345/88, 89, 102, 204, 205, 690; 362/561; 349/61

See application file for complete search history.

(56) References Cited

U.S. PATENT DOCUMENTS

| | | | | |
|---|---|---|---|---|
| 6,107,981 | A * | 8/2000 | Fujita | 345/95 |
| 6,556,181 | B2 | 4/2003 | Yamada et al. | |
| 6,570,554 | B1 | 5/2003 | Makino et al. | |
| 6,909,411 | B1 * | 6/2005 | Yamazaki et al. | 345/87 |
| 2001/0038371 | A1 | 11/2001 | Yoshinaga et al. | |
| 2002/0000960 | A1 | 1/2002 | Yoshihara et al. | |
| 2002/0084973 | A1 | 7/2002 | Choi et al. | |
| 2002/0158823 | A1 | 10/2002 | Zavracky et al. | |
| 2002/0196220 | A1 | 12/2002 | Sato et al. | |
| 2003/0011559 | A1 | 1/2003 | Adachi et al. | |
| 2003/0043103 | A1 | 3/2003 | Yoshihara et al. | |
| 2003/0058399 | A1 | 3/2003 | Miyashita | |
| 2003/0107538 | A1 | 6/2003 | Asao et al. | |

FOREIGN PATENT DOCUMENTS

| | | | |
|---|---|---|---|
| CN | 1160260 | A1 | 9/1997 |
| CN | 1188789 | A1 | 7/1998 |
| CN | 1438527 | A1 | 8/2003 |
| DE | 690 25 341 | T2 | 8/1996 |
| EP | 0 997 868 | A1 | 5/2000 |
| EP | 1 253 577 | A1 | 10/2002 |

(Continued)

*Primary Examiner*—Abbas I Abdulselam
(74) *Attorney, Agent, or Firm*—McKenna Long & Aldridge LLP

(57) ABSTRACT

A liquid crystal display device and a driving method thereof for preventing a color distortion phenomenon in a field-sequential driving system are disclosed. In the liquid crystal display device, a data driver sequentially supplies a green data signal, a red data signal and a blue data signal to the data lines. A gate driver applies a scanning pulse to gate lines. A light source irradiates a green light onto a liquid crystal cell during a time interval when the green data signal is maintained at the liquid crystal cell, irradiates a red light onto the liquid crystal cell during a time interval when the red data signal is maintained at the liquid crystal cell, and irradiates a blue light to the liquid crystal cell during a time interval when the blue data signal is maintained at the liquid crystal cell.

9 Claims, 5 Drawing Sheets

FOREIGN PATENT DOCUMENTS

| | | |
|---|---|---|
| JP | 04-310925 | 11/1992 |
| JP | 11-338423 | 12/1999 |
| JP | 2003-029235 | 1/2003 |
| JP | 2003-222835 | 8/2003 |
| JP | 2003-270699 | 9/2003 |

* cited by examiner

LIQUID CRYSTAL DISPLAY DEVICE AND DRIVING METHOD THEREOF

This application claims the benefit of Korean Patent Application No. P2003-86957 filed in Korea on Dec. 2, 2003, which is hereby incorporated by reference for all purposes as if fully set forth herein.

BACKGROUND OF THE INVENTION

1. Field of the Invention

This invention relates to a liquid crystal display device, and more particularly to a liquid crystal display device and a driving method thereof that can prevent a color distortion phenomenon.

2. Discussion of the Related Art

Generally, a liquid crystal display (LCD) device controls the light transmittance of liquid crystal cells in accordance with video signals to display pictures. A LCD device of an active matrix type having a switching device provided for each liquid crystal cell is suitable for displaying moving pictures. A thin film transistor (TFT) is generally employed as a switching device for the active-matrix type LCD.

FIG. 1 is a schematic sectional view illustrating a structure of a liquid crystal display (LCD) panel of a related art LCD device.

Referring to FIG. 1, in the LCD panel, color filters 6 and a common electrode 4 are disposed on a upper substrate while a pixel electrode 10 is provided on a lower substrate 12. A liquid crystal 8 is provided between the upper substrate 2 and the lower substrate 12. A white lamp 14 acting as a backlight source is provided under the lower substrate 12. On the upper substrate 2, black matrices (not shown) are provided among the red, green and blue color filters 6. Each of the upper substrate 2 and the lower substrate 12 has an alignment film (not shown) formed on the interface surface that is in contact with the liquid crystal 8. On the lower substrate 12, gate lines and data lines perpendicularly cross each other, and a TFT is provided at each crossing of the gate lines and the data lines. The TFT provides a channel between a source terminal thereof connected to the data line and a drain terminal thereof connected to the pixel electrode 10 in response to a scanning pulse applied, via the gate line, to a gate electrode thereof, thereby applying a data signal to the pixel electrode 10. The pixel electrode 10 is provided within a pixel area that is enclosed by the gate lines and the data lines.

In such a LCD panel, a voltage is applied to the white lamp 14 to continuously irradiate a white light onto the LCD panel. When the white lamp is turned on, the scanning pulse turns on the TFTs to simultaneously apply red, green and blue data signals to the corresponding liquid crystal cells. As a result, the white light (backlight) irradiated onto the LCD panel passes through the liquid crystal cells and the red, green and blue color filters 6, and thus becomes a red light, a green light and a blue light. The LCD panel displays a desired color by a combination of the red, green and blue lights.

The LCD panel according to the related art has a drawback in that the backlight looses approximately one-third of its intensity while passing through the color filer 6, which raises a problem of low brightness. In order to solve such a problem, a field-sequential driving method has been suggested.

FIG. 2 is a schematic sectional view of a LCD panel driven by a field-sequential driving method according to a related art.

Referring to FIG. 2, the LCD panel has no color filter, but includes a red lamp 36R, a green lamp 36G and a blue lamp 36B. Black matrices (not shown) are provided on a upper substrate 22 of the LCD panel. Each of the upper substrate 22 and a lower substrate 32 has an alignment film (not shown) formed on the interface surface that is in contact with a liquid crystal 28. On the lower substrate 32, gate lines and data lines perpendicularly cross each other, and a TFT are provided at each crossing of the gate lines and the data lines. The TFT provides a channel between a source terminal thereof connected to the data line and a drain terminal thereof connected to a pixel electrode 30 in response to a scanning pulse applied, via the gate line, to a gate electrode thereof, thereby applying a data signal to the pixel electrode 30. The pixel electrode 30 is provided within a pixel area that is enclosed by the gate lines and the data lines. In such a field-sequential driving method, a lamp driving voltage is sequentially supplied to the red lamp 36R, the green lamp 36G and the blue lamp 36B to sequentially irradiate red, green and blue lights to the LCD panel.

According to such a field-sequential driving method in which red, green and blue lights are sequentially irradiated onto liquid crystal cells during one frame interval, light transmittance becomes higher in the order of the red light, the green light and the blue light due to a cumulative response characteristic of the liquid crystal, thereby raising a color distortion problem. In other words, the cumulative response characteristic of the liquid crystal distorts the light transmittance, and when the red, green and blue lights from the red, green and blue lamps 36R, 36G and 36B pass through the liquid crystal, the distorted light transmittance distorts the color of the liquid crystal cell.

Such a color distortion phenomenon distinctly appears when a yellow color is displayed. According to such a field-sequential driving method, a yellow color can be displayed by sequentially driving a red light and a green light. Because of the time resolving power of human beings, the sequentially driven red and green lights can be recognized as a yellow color. Because the green light is transmitted to the liquid crystal cell after the red light when displaying a yellow color, the transmittance of the red light becomes lower than that of the green light due to the cumulative response characteristic of the liquid crystal. In this case, because the green light contributes to the brightness of the liquid crystal cells twice as much as the red light (wherein brightness contribution degree has generally a relationship of R:G:B=3:6:1), a yellow color close to a green color is displayed on the LCD panel, thereby raising a color distortion problem.

SUMMARY OF THE INVENTION

Accordingly, the present invention is directed to a liquid crystal display device and a driving method thereof that substantially obviate one or more of the problems due to limitations and disadvantages of the related art.

An advantage of the present invention is to provide a liquid crystal display device and a driving method thereof that can prevent a color distortion phenomenon in a field-sequential driving system.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a plurality of data lines and a plurality of gate lines defining a plurality of liquid crystal cells; a data driver for sequentially supplying a green data signal, a red data signal and a blue data signal to the data lines; a gate driver for applying a scanning pulse to the gate lines; and a light source for irradiating a green light onto the liquid crystal cell during a time interval when the green data signal is maintained at the liquid crystal cell, irradiating a red light onto the liquid crystal cell during a time interval when the red data signal is maintained at the liquid crystal cell, and irradiating a blue light to the liquid crystal cell during a time interval when the blue data signal is maintained at the liquid crystal cell.

In another aspect of the present invention, a method of driving a liquid crystal display device includes forming a liquid crystal cell arranged in a matrix at intersections between a plurality of data lines and a plurality of gate lines; irradiating a green light onto the liquid crystal cell during a time interval when a green data is maintained at the liquid crystal cell; irradiating a red light onto the liquid crystal cell during a time interval when a red data is maintained at the liquid crystal cells; and irradiating a blue light onto the liquid crystal cell during a time interval when a blue data is maintained at the liquid crystal cells.

In yet another aspect of the present invention, a method of driving a flat panel display device having a pixel includes dividing one frame interval into green, red and blue sub-frames; sequentially applying a green data signal within the green sub-frame, a red data signal within the red sub-frame and a blue data signal within the blue sub-frame to the pixel; and sequentially supplying a green light within the green sub-frame, a red light within the red sub-frame and a blue light within the blue sub-frame to the pixel.

In still another aspect of the present invention, a flat panel display device having a pixel includes a timing controller dividing one frame interval into green, red and blue sub-frames; a data driver sequentially applying a green data signal within the green sub-frame, a red data signal within the red sub-frame and a blue data signal within the blue sub-frame to the pixel; and a light-source controller sequentially supplying a green light within the green sub-frame, a red light within the red sub-frame and a blue light within the blue sub-frame to the pixel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figure 1:
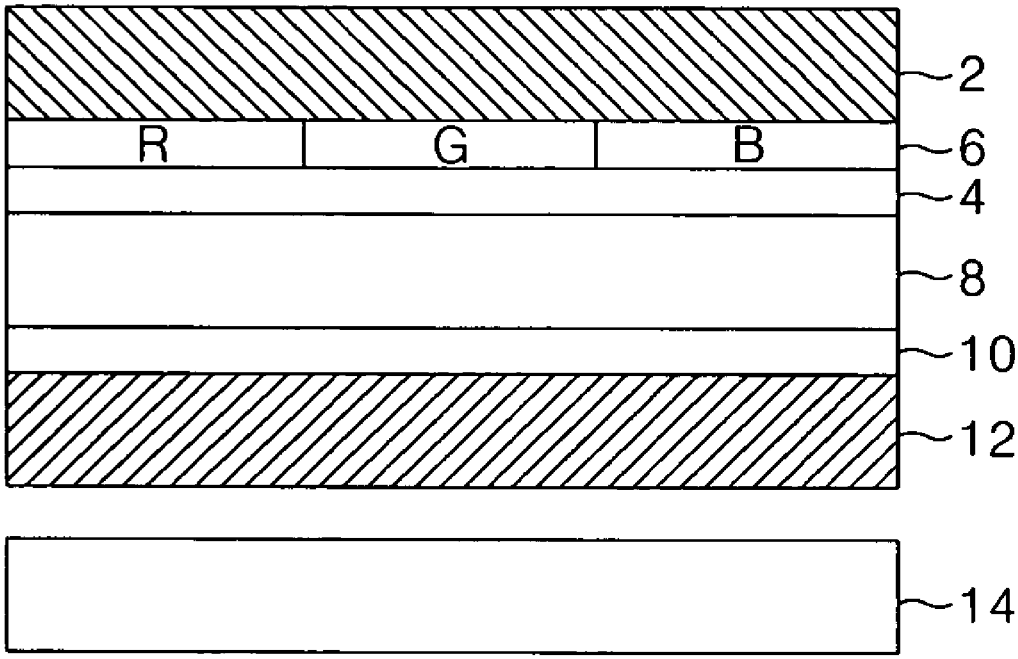
FIG. 1 RELATED ART
FIG. 1 is a schematic sectional view illustrating a structure of a liquid crystal display panel of a related art liquid crystal display device.
Figure 2:
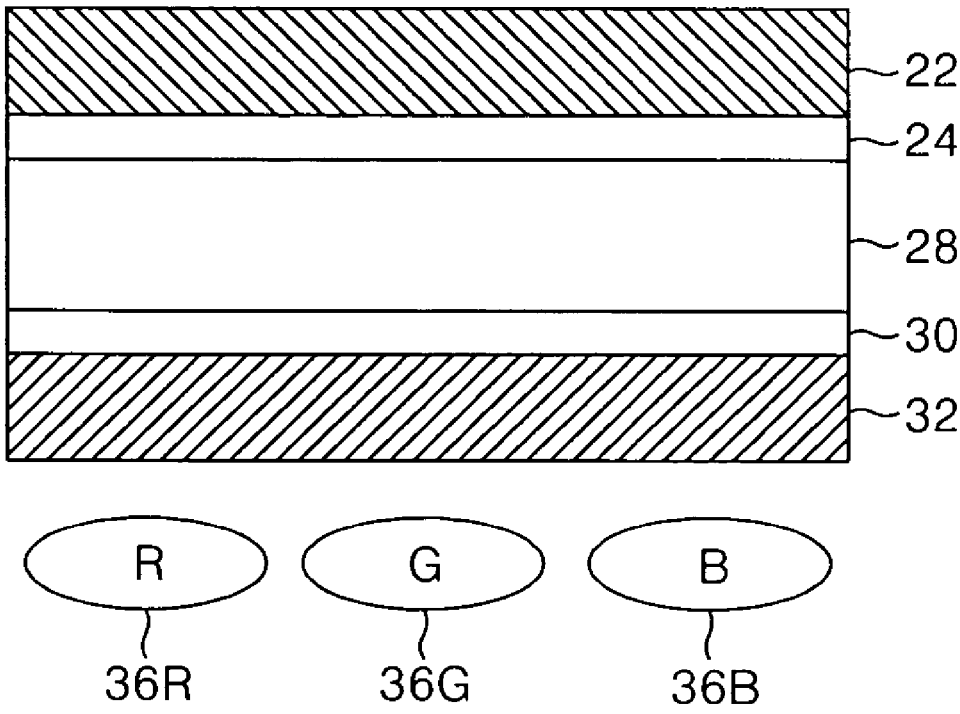
FIG. 2 RELATED ART
FIG. 2 is a schematic sectional view illustrating a structure of a liquid crystal display panel driven by a field-sequential driving method according to a related art.
Figure 3:
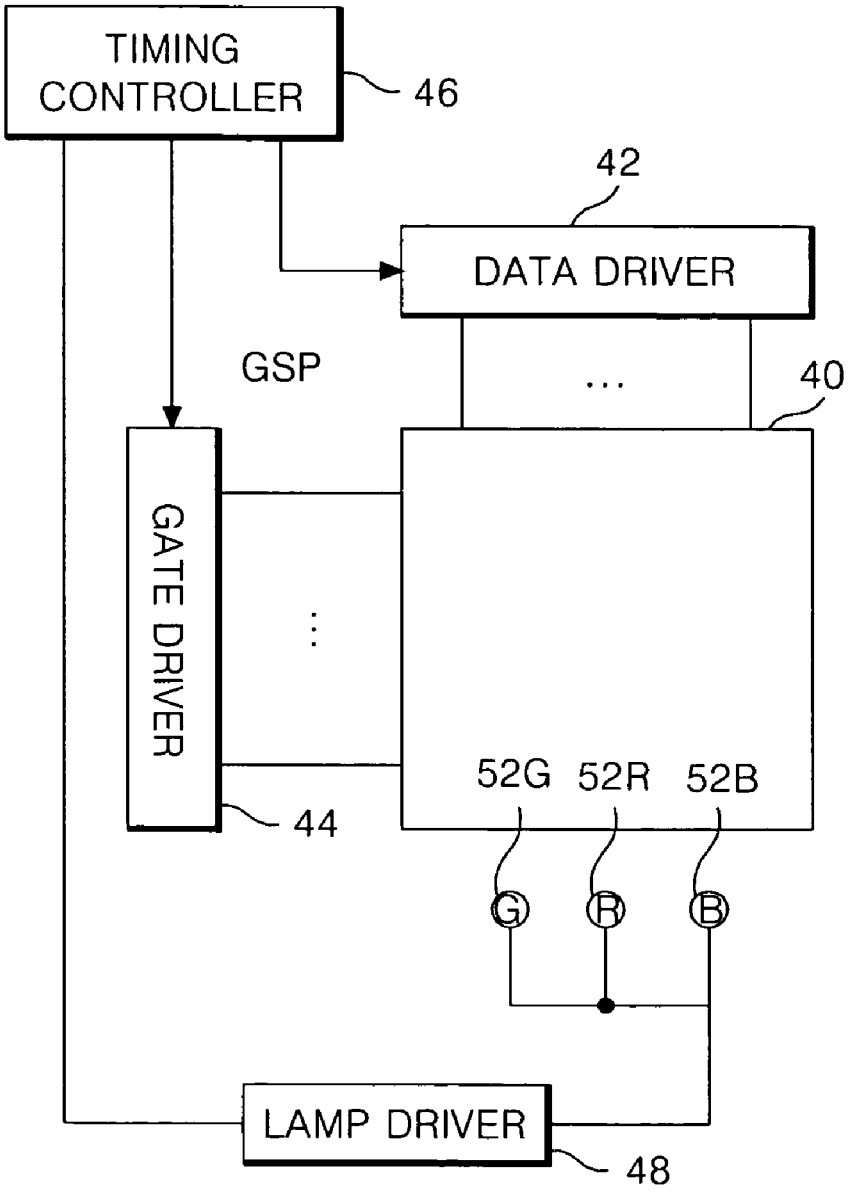
FIG. 3 is a schematic block diagram illustrating a configuration of a liquid crystal display device according to an embodiment of the present invention.

FIG. 3 illustrates a liquid crystal display device according to an embodiment of the present invention.

Referring to FIG. 3, the liquid crystal display (LCD) device includes a liquid crystal display (LCD) panel 40 having data lines and gate lines crossing each other and TFT's provided at the crossings, a data driver 42 for applying data signals to the data lines of the LCD panel 40, a gate driver 44 for applying scanning pulses to the gate lines of the LCD panel 40, a timing controller 46 supplied with digital video signals and synchronizing signals H and V, and a lamp driver 48 for driving a green lamp 52G, a red lamp 52R and a blue lamp 52B.

The LCD panel 40 has a liquid crystal provided between two glass substrates. According to the principles of the present invention, the LCD panel 40 may utilize OCB (Optically Compensated Birefringence) mode, TN (Twisted Nematic) mode, ferroelectric liquid crystal mode, or the like. When the TN mode is utilized, the LCD panel 40 includes a twisted nematic liquid crystal, and the thickness of the twisted nematic liquid crystal is in a range of about 0.1 to about 4 μm. When the ferroelectric liquid crystal mode is used, the LCD panel 40 includes a ferroelectric liquid crystal. The TFT provided at each crossing of the data lines and the gate lines of the LCD panel 40 applies a data signal on the data lines to liquid crystal cells arranged in a matrix form in response to a scanning pulse from the gate driver 44. The source electrode of the TFT is connected to the data line, and the drain electrode thereof is connected to a pixel electrode of the liquid crystal cell. Further, the gate electrode of the TFT is connected to the gate line.

The timing controller 46 applies control signals to the data driver 42 and the gate driver 44 to drive the LCD panel 40 while dividing one frame (e.g., 16.7 ms) into three green(G), red(R) and blue(B) sub-frames. In this case, each sub-frame (e.g., 5.56 ms when one frame is 16.7 ms) is further divided into a data writing interval, a liquid crystal response interval and a lamp turning-on interval.

To this end, the timing controller 46 re-aligns the digital video signals from a digital video card (not shown) for each green(G), red(R) and blue(B) color. The digital video signals (GRB) re-aligned by the timing controller 46 is applied to the data driver 42. Further, the timing controller 46 generates data control signals and gate control signals with a frequency required for a field-sequential driving method using horizontal/vertical synchronizing signals H and V inputted thereto. The data control signals include a dot clock Dclk, a source shift clock SSC, a source output enable signal SOE and a polarity inversion signal POL, etc. to be applied to the data driver 42. The gate control signals include a gate start pulse GSP, a gate shift clock GSC and a gate output enable signal GOE, etc. to be applied to the gate driver 44. Also, the timing controller 46 controls the lamp driver 48 such that the green lamp 52G, the red lamp 52R and the blue lamp 52B are sequentially driven at a time when a data signal is completely supplied to the liquid crystal cell. Such a timing controller may be referred to simply as a "controller" because it controls the data driver 42, the gate driver 44 and the lamp driver 48.

The data driver 42 samples a data signal in response to the data control signals from the timing controller 46 and then latches the sampled data signal for each one line. Further, the data driver 42 converts the latched data signal into analog gamma voltages from a gamma voltage supplier (not shown).

The gate driver 44 sequentially generates a scanning pulse in response to a gate start pulse GSP of the gate control signals from the timing controller 46. Thus, the gate driver 44 applies the scanning pulse to the gate line to turn on the TFT, thereby applying a data signal (analog gamma voltages) on the data line to the liquid crystal cell and maintaining the data signal in the liquid crystal cell. In this case, the scanning pulse has the same voltage as a gate high voltage. Also, during the data sustain period of the liquid crystal cell, the scanning pulse may be applied or may not be applied to the gate line.

The lamp driver 48, which is controlled by the timing controller 46, turns on any one of the green, red and blue lamps 52G, 52R and 52B to apply any one of green, red and blue lights to the liquid crystal cell when a data signal is completely supplied to the liquid crystal within each sub-frame.

Figure 4:
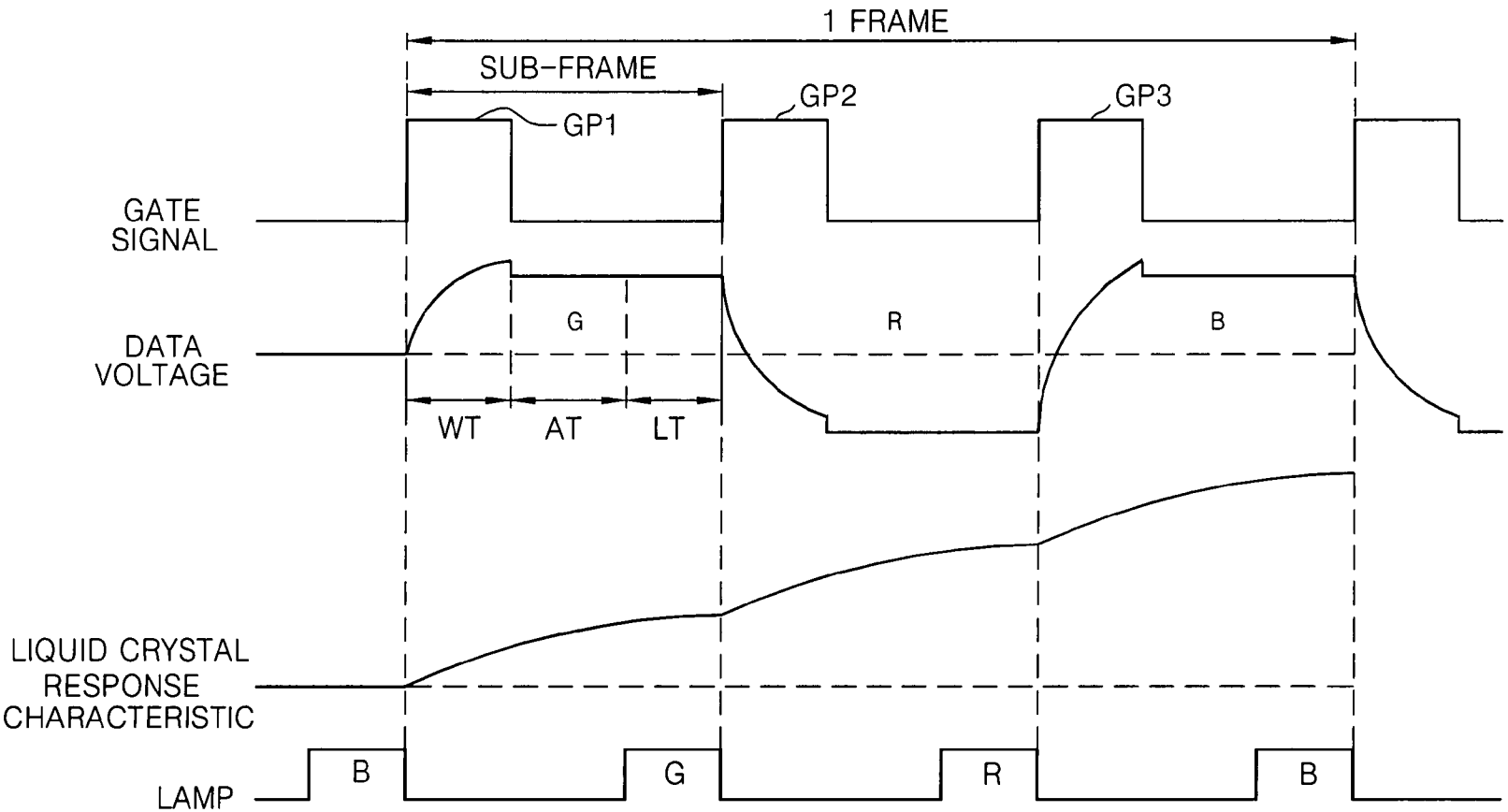
FIG. 4 is a waveform diagram of driving signals according to a field-sequential driving system of the liquid crystal display device shown in FIG. 3.

Such a LCD device displays a picture on the LCD panel by applying, for example, the waveforms of the various signals shown in FIG. 4.

Referring to FIG. 4, a field-sequential driving method according to an embodiment of the present invention divides one frame (e.g., 16.7 ms) of the LCD panel into three green (G), red(R) and blue(B) sub-frames. Each sub-frame (e.g., 5.56 ms when one frame is 16.7 ms) is further divided into a data writing interval WT, a liquid crystal response interval AT and a lamp turning-on interval LT. A data signal is applied to the pixel electrode of the LCD panel during the data writing interval WT in response to a scanning pulse GP, and the data signal applied to the pixel electrode of the LCD panel is constantly maintained during the liquid crystal response interval AT. Further, the lamps transmit light to the liquid crystal during the lamp turning-on interval LT, a time interval during which the data signal applied to the pixel electrode of the LCD panel is maintained, thereby displaying a desired color. Still referring to FIG. 4, the field-sequential driving method supplies a green data voltage to the liquid crystal cell using a scanning pulse GP1 during the data writing interval WT in the first sub-frame; constantly maintains the green data voltage supplied to the liquid crystal cell during the liquid crystal response interval AT; and turns on the green lamp 52G by the lamp driver 48 during the lamp turning-on interval LT, thereby transmitting a green light to the liquid crystal cell supplied with the green data voltage. Thus, in the first sub-frame of one frame, a green light is displayed on the liquid crystal cell supplied with the green data voltage. In this case, in order to drive the green lamp 52G, the lamp driver 48 supplies a voltage of about 3.9V to 4.1V, beneficially a voltage of 4V, to the green lamp 52G. In the second sub-frame, the present method supplies a red data voltage to the liquid crystal cell using a scanning pulse GP2 during the data writing interval WT; constantly maintains the red data voltage supplied to the liquid crystal cell during the liquid crystal response interval AT; and turns on the red lamp 52R by the lamp driver 48 during the lamp turning-on interval LT, thereby transmitting a red light to the liquid crystal cell supplied with the red data voltage. Thus, in the second sub-frame, a red light is displayed on the liquid crystal cell supplied with the red data voltage. In this case, in order to drive the red lamp 52R, the lamp driver 48 supplies a voltage of about 2.9V to 3.1 V, beneficially a voltage of 3V, to the red lamp 52R. In the third sub-frame, the present method supplies a blue data voltage to the liquid crystal cell using a scanning pulse GP3 during the data writing interval WT; constantly maintains the blue data voltage supplied to the liquid crystal cell during the liquid crystal response interval AT; and turns on the blue lamp 52B by the lamp driver 48 during the lamp turning-on interval LT, thereby transmitting a blue light to the liquid crystal cell supplied with the blue data voltage. Thus, in the third sub-frame, a blue light is displayed on the liquid crystal cell supplied with the blue data voltage. In this case, in order to drive the blue lamp 52B, the lamp driver 48 supplies a voltage of about 3.6V to 3.8V, beneficially a voltage of 3.7V, to the blue lamp 52B. This exemplary lamp voltage is applicable when a light emitting diode is used for the lamps. Thus, the driving voltage is generally in a range of 1V~15V. However, it should be understood that a cold cathode fluorescent lamp or an external electrode fluorescent lamp may be used for the lamps.

As a result, the field-sequential driving method according to the embodiment of the present invention displays pictures by dividing one frame into sub-frames, with an interval of each sub-frame being equal to or less than ⅓ of one frame interval, and by transmitting green, red and blue lights to the LCD panel for each sub-frame. In other words, the method of driving the LCD device employing the field-sequential driving system according to the embodiment of the present invention sequentially supplies green(G), red(R) and blue(B) data voltages to the liquid crystal cell during one frame interval, and thus sequentially transmits green(G), red(R) and blue(B) lights corresponding to the green(G), red(R) and blue(B) data voltages to the LCD panel. In this case, one frame interval includes sub-frames for each of the green(G), red(R) and blue(B) data voltages, and each sub-frame interval is equal to or less than ⅓ of one frame interval.

Hereinafter, a way in which a yellow color is displayed by the field-sequential driving method according to the embodiment of the present invention will be described with reference to FIG. 5.

Figure 5:
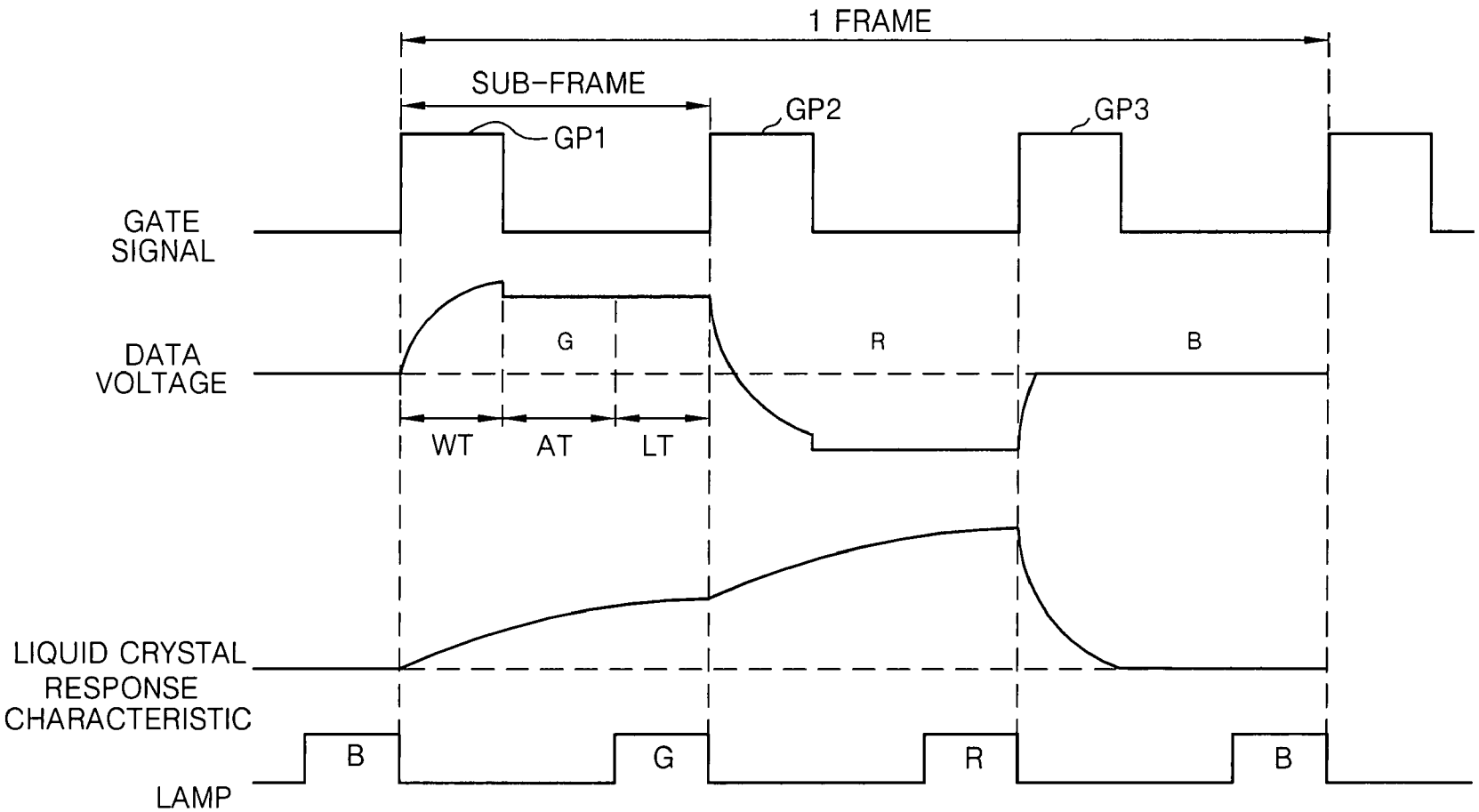
FIG. 5 is a waveform diagram of driving signals for displaying a yellow color in accordance with the field-sequential driving system of the liquid crystal display device shown in FIG. 3.

Referring to FIG. 5, in the first sub-frame, a green data voltage is supplied to the liquid crystal cell in response to the first scanning pulse GP1 during the data writing interval WT, and the green data voltage supplied to the liquid crystal cell is constantly maintained during the liquid crystal response interval AT. During the lamp turning-on interval LT, the lamp driver 48 supplies a voltage of approximately 3.9V to 4.1V, beneficially a voltage of 4V, to the green lamp 52G to thereby turn on the green lamp 52G. Accordingly, a green light is transmitted to the liquid crystal cell to which the green data voltage is supplied by turning on the green lamp 52G. Thus, a green light is displayed on the liquid crystal cell supplied with the green data voltage in the first sub-frame of one frame. This exemplary lamp voltage is applicable when a light emitting diode is used for the lamp 52G. Thus, the driving voltage is generally in a range of 1V~15V. However, it should be understood that a cold cathode fluorescent lamp or an external electrode fluorescent lamp may be used for the lamp 52G.

In the second sub-frame, a red data voltage is supplied to the liquid crystal cell in response to the second scanning pulse GP2 during the data writing interval WT, and the red data voltage supplied to the liquid crystal cell is constantly maintained during the liquid crystal response interval AT. During the lamp turning-on interval LT, the lamp driver 48 supplies a voltage of approximately 2.9V to 3.1V, beneficially a voltage of 3V, to the red lamp 52R to thereby turn on the red lamp 52R. Accordingly, a red light is transmitted to the liquid crystal cell to which the red data voltage is supplied by turning on the red lamp 52R. Thus, a red light is displayed on the liquid crystal cell supplied with the red data voltage in the second sub-frame of one frame. This exemplary lamp voltage is applicable when a light emitting diode is used for the lamp 52R. Thus, the driving voltage is generally in a range of 1V~15V. However, it should be understood that a cold cathode fluorescent lamp or an external electrode fluorescent lamp may be used for the lamp 52R.

In the third sub-frame, a blue data voltage is supplied to the liquid crystal cell in response to the third scanning pulse GP3 during the data writing interval WT, and the blue data supplied to the liquid crystal cell is constantly maintained during the liquid crystal response interval AT. During the lamp turning-on interval LT, the lamp driver 48 supplies a voltage of approximately 3.6V to 3.8V, beneficially a voltage of 3.7V, to the blue lamp 52B to thereby turn on the blue lamp 52B. However, when displaying a yellow color, the blue lamp 52B is not turned on, because the blue data voltage has a value of '0' (black voltage). This exemplary lamp voltage is applicable when a light emitting diode is used for the lamp 52B. Thus, the driving voltage is generally in a range of 1V~15V. However, it should be understood that a cold cathode fluorescent lamp or an external electrode fluorescent lamp may be used for the lamp 52B.

As a result, the liquid crystal cell displays a yellow color by mixing the green light of the first sub-frame with the red light of the second sub-frame.

In the method of driving the LCD device employing the field-sequential driving system according to the embodiment of the present invention, when displaying a yellow color, a red light from the red lamp 52R is transmitted to the liquid crystal during the second sub-frame after a green light from the green lamp 52G is transmitted to the liquid crystal during the first sub-frame. At this time, the light transmittance of the liquid crystal in the second sub-frame, which corresponds to the red data voltage, has a value incorporating the cumulative light transmittance of the first sub-frame during which a green light is transmitted to the liquid crystal, due to the cumulative response characteristic of the liquid crystal described in the earlier section. Accordingly, the transmittance of the red light transmitting the liquid crystal in the second sub-frame becomes higher than that of the green light transmitting the liquid crystal in the first sub-frame. In this case, because the green light contributes to the brightness of the LCD panel more than the red light, the color distortion phenomenon caused by the cumulative response characteristic of the liquid crystal can be prevented or reduced, especially when displaying a yellow color on the LCD device.

As described above, according to the present invention, a green light having a high brightness contribution degree is transmitted to the liquid crystal cell and then a red light is transmitted to the liquid crystal cell to which the green light has been transmitted, thereby increasing transmittance of the red light and preventing or reducing a color distortion phenomenon caused by the accumulated response characteristic of the liquid crystal.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device dividing one frame into green, red and blue sub-frames, comprising:

a plurality of data lines and a plurality of gate lines defining a plurality of liquid crystal cells;

a data driver for sequentially supplying a green data signal during the green sub-frame, a red data signal during the red sub-frame and a blue data signal during the blue sub-frame to the data lines;

a gate driver for applying a scanning pulse to the gate lines; and a light source for irradiating a green light onto the liquid crystal cells during the green sub-frame after the green data signal is maintained at the liquid crystal cells, irradiating a red light onto the liquid crystal cells during the red sub-frame after the red data signal is maintained at the liquid crystal cells, and irradiating a blue light to the liquid crystal cells during the blue sub-frame after the blue data signal is maintained at the liquid crystal cells, wherein the light transmittance of the liquid crystal cells at the later sub-frame has a value incorporating the cumulative light transmittance of the liquid crystal cells at the prior sub-frame.

2. The liquid crystal display device according to claim 1, wherein the gate driver synchronizes the scanning pulse with the green, red and blue data signals.

3. The liquid crystal display device according to claim 1, further comprising:

a controller for controlling the data driver, the gate driver and the light source.

4. The liquid crystal display device according to claim 1, wherein the light source includes:

a light-source supplying the green light during the green sub-frame after the green data signal is maintained at the liquid crystal cell;

a light-source supplying the red light during the red sub-frame after the red data signal is maintained at the liquid crystal cell; and a light-source supplying the blue light during the blue sub-frame after the blue data signal is maintained at the liquid crystal cell.

5. The liquid crystal display device according to claim 1, wherein the light source is a florescent lamp or a light emitting diode.

6. A method of driving a liquid crystal display device dividing one frame into green, red and blue sub-frames, comprising:

forming a plurality of liquid crystal cells arranged in a matrix at intersections between a plurality of data lines and a plurality of gate lines;

sequentially supplying a green data signal during the green sub-frame, a red data signal during the red sub-frame and a blue data signal during the blue sub-frame to the data lines;

applying a scanning pulse to the gate lines;

irradiating a green light onto the liquid crystal cells during the green sub-frame after a green data is maintained at the liquid crystal cells;

irradiating a red light onto the liquid crystal cells during the red sub-frame after a red data is maintained at the liquid crystal cells; and irradiating a blue light onto the liquid crystal cells during the blue sub-frame after a blue data is maintained at the liquid crystal cells, wherein the light transmittance of the liquid crystal cells at the later sub-frame has a value incorporating the cumulative light transmittance of the liquid crystal cells at the prior sub-frame.

7. The method according to claim 6, wherein the irradiating a green light includes:

supplying the green data to the data lines and, at the same time, supplying a scanning pulse to the gate lines.

8. The method according to claim 6, wherein the irradiating a red light includes:

supplying the red data to the data lines and, at the same time, supplying a scanning pulse to the gate lines.

9. The method according to claim 6, wherein the irradiating a blue light includes:

supplying the blue data to the data lines and, at the same time, supplying a scanning pulse to the gate lines.

* * * * *